US008313336B2

(12) United States Patent
Bondo et al.

(10) Patent No.: US 8,313,336 B2
(45) Date of Patent: Nov. 20, 2012

(54) ASSEMBLY COMPRISING A MALE AND A FEMALE PLUG MEMBER, A MALE PLUG MEMBER AND A FEMALE PLUG MEMBER

(75) Inventors: Martin Bondo, Værløse (DK); Christian Dela, Bunkeflostrand (SE)

(73) Assignee: Sonion A/S, Roskilde (DK)

( * ) Notice: Subject to any disclaimer, the term of this patent is extended or adjusted under 35 U.S.C. 154(b) by 22 days.

(21) Appl. No.: 12/708,632

(22) Filed: Feb. 19, 2010

(65) Prior Publication Data

US 2011/0189880 A1 Aug. 4, 2011

Related U.S. Application Data

(60) Provisional application No. 61/300,289, filed on Feb. 1, 2010.

(51) Int. Cl.
*H01R 4/50* (2006.01)

(52) U.S. Cl. ..... 439/324; 439/953

(58) Field of Classification Search ..... 439/953, 439/660, 364, 348, 350, 324, 345
See application file for complete search history.

(56) References Cited

U.S. PATENT DOCUMENTS

| | | | | | |
|---|---|---|---|---|---|
| 1,794,777 | A | * | 3/1931 | Kliegl | 439/353 |
| 1,828,276 | A | * | 10/1931 | Beers | 439/553 |
| 1,978,076 | A | * | 10/1934 | Cassedy, Jr. | 439/690 |
| 2,313,481 | A | * | 3/1943 | Rendano | 416/100 |
| 2,428,214 | A | * | 9/1947 | Gorey | 439/593 |
| 2,494,428 | A | * | 1/1950 | Buck | 439/351 |
| 2,563,712 | A | * | 8/1951 | Frei et al. | 439/279 |
| 2,739,292 | A | * | 3/1956 | Modrey et al. | 439/324 |
| 2,749,526 | A | * | 6/1956 | Petersen | 439/320 |
| 2,871,456 | A | * | 1/1959 | Healy | 439/140 |
| 2,892,990 | A | * | 6/1959 | Werndl | 439/265 |
| 3,159,444 | A | * | 12/1964 | Stine, Jr. | 439/255 |
| 3,626,356 | A | * | 12/1971 | Trammell | 439/205 |
| 3,648,002 | A | * | 3/1972 | Du Rocher | 200/265 |

(Continued)

FOREIGN PATENT DOCUMENTS

CH 669296 A5 2/1989

(Continued)

OTHER PUBLICATIONS

Search Report corresponding to European Patent Application No. 11152572.1, European Patent Office, dated May 23, 2011, 3 pages.

*Primary Examiner* — Neil Abrams
(74) *Attorney, Agent, or Firm* — Nixon Peabody LLP

(57) ABSTRACT

An assembly having a male and female plug. The female plug has an elongate cavity extending along a longitudinal axis and having in the cavity signal conducting elements. The male plug has an outer surface positioned partly within the cavity with signal conducting elements provided on the outer surface, and clicking elements. The female plug has clicking elements that click or latch together with the clicking elements of the male plug when it is introduced into the female plug along the longitudinal axis. The signal conducting elements engage one another when the clicking elements of the male and female plugs are clicked together. The clicking elements of the female plug are positioned, in a cross section in a plane perpendicular to the longitudinal axis, symmetrically relative to a center point, in the plane, between positions of the clicking elements.

23 Claims, 3 Drawing Sheets

U.S. PATENT DOCUMENTS

| | | | | | |
|---|---|---|---|---|---|
| 3,706,067 | A | * | 12/1972 | Hanson | 439/155 |
| 3,732,516 | A | * | 5/1973 | Puetz | 337/194 |
| 3,831,133 | A | * | 8/1974 | Grundfest | 439/680 |
| 4,025,964 | A | * | 5/1977 | Owens | 623/11.11 |
| 4,083,619 | A | * | 4/1978 | McCormick et al. | 439/310 |
| 4,255,007 | A | * | 3/1981 | Michaels et al. | 439/332 |
| 4,565,001 | A | * | 1/1986 | Patton | 29/866 |
| 4,657,327 | A | * | 4/1987 | Weingartner | 439/289 |
| 4,709,975 | A | * | 12/1987 | Williams, II | 439/350 |
| 4,712,861 | A | * | 12/1987 | Lukas et al. | 385/58 |
| 4,828,510 | A | * | 5/1989 | Muzslay | 439/352 |
| 4,886,462 | A | * | 12/1989 | Fierro | 439/79 |
| 4,955,828 | A | * | 9/1990 | Gruenberg | 439/668 |
| 5,017,136 | A | * | 5/1991 | Gatti | 433/98 |
| 5,044,975 | A | * | 9/1991 | DiBene et al. | 439/352 |
| 5,106,321 | A | * | 4/1992 | Haroutel | 439/310 |
| 5,109,453 | A | * | 4/1992 | Edwards et al. | 385/90 |
| 5,188,540 | A | * | 2/1993 | Haertl et al. | 439/500 |
| 5,190,474 | A | * | 3/1993 | Ginet | 439/581 |
| 5,202,943 | A | * | 4/1993 | Carden et al. | 385/92 |
| 5,404,407 | A | * | 4/1995 | Weiss | 381/314 |
| 5,439,387 | A | * | 8/1995 | Hayashi | 439/345 |
| 5,454,729 | A | * | 10/1995 | Wen-Te | 439/357 |
| 5,538,437 | A | * | 7/1996 | Bates et al. | 439/352 |
| 5,586,893 | A | * | 12/1996 | Mosquera | 439/108 |
| 5,641,309 | A | | 6/1997 | Crane, Jr. | |
| 5,689,598 | A | * | 11/1997 | Dean et al. | 385/59 |
| 5,717,771 | A | * | 2/1998 | Sauer et al. | 381/328 |
| 5,791,932 | A | * | 8/1998 | Hasenfratz | 439/347 |
| 5,823,812 | A | * | 10/1998 | Bhargava et al. | 439/345 |
| 5,848,456 | A | * | 12/1998 | Sjoqvist | 24/618 |
| 6,010,369 | A | * | 1/2000 | Itabashi et al. | 439/660 |
| 6,033,250 | A | * | 3/2000 | Pauza | 439/357 |
| 6,044,164 | A | * | 3/2000 | Ach-Kowalewski | 381/314 |
| 6,146,180 | A | * | 11/2000 | Betker et al. | 439/352 |
| 6,328,606 | B1 | * | 12/2001 | Davis et al. | 439/660 |
| 6,663,410 | B2 | * | 12/2003 | Revis | 439/348 |
| 7,285,005 | B2 | * | 10/2007 | Gabrielsson et al. | 439/378 |
| 7,946,890 | B1 | * | 5/2011 | Bondo et al. | 439/638 |
| 7,955,111 | B2 | * | 6/2011 | Costabel et al. | 439/287 |
| 8,007,305 | B2 | * | 8/2011 | Chen | 439/357 |
| 2010/0323548 | A1 | * | 12/2010 | Daubigney | 439/345 |
| 2011/0039440 | A1 | * | 2/2011 | Daubigney | 439/350 |

FOREIGN PATENT DOCUMENTS

| | | | |
|---|---|---|---|
| CH | 673551 | A5 | 3/1990 |
| DE | 10312987 | B4 | 10/2004 |
| EP | 0484107 | A1 | 5/1992 |

* cited by examiner

ASSEMBLY COMPRISING A MALE AND A FEMALE PLUG MEMBER, A MALE PLUG MEMBER AND A FEMALE PLUG MEMBER

CROSS-REFERENCE TO RELATED APPLICATION

This application claims the benefit of U.S. Provisional Application Ser. No. 61/300,289, filed Feb. 1, 2010, entitled "An Assembly Comprising A Male And A Female Plug Member, A Male Plug Member And A Female Plug Member."

FIELD OF THE INVENTION

The present invention relates to an improvement in plugs especially for hearing aids or other miniature transducers. In particular, a plug assembly is described which may be snap switched together without exerting excessive force to the signal conductors, such as electrical conductors and/or without requiring the snap latching or switching force being generated by the signal conductors of the assembly. Especially in miniature elements, the conductors usually must be very small and thus may not be able to generate the desired forces without breaking.

SUMMARY OF THE INVENTION

A first aspect of the invention relates to an assembly comprising a male and a female plug member, wherein:

- the female plug member has an elongate cavity extending along a longitudinal axis and having in the cavity one or more first signal conducting elements,
- the male plug member having an outer surface being adapted to be positioned at least partly within the cavity, one or more second signal conducting elements being provided at or on the outer surface,
- the male plug member having one or more first clicking elements,
- the female plug member having one or more second clicking elements being adapted to interact with and click together with the first clicking elements when the male plug member is introduced into the female plug member along the longitudinal axis,
- the first and second signal conducting elements being positioned so as to engage or abut when the first and second clicking elements are clicked together,
- wherein the second clicking element(s) is/are positioned, in a cross section in a plane perpendicular to the longitudinal axis, symmetrically in relation to a centre point, in the plane, between positions of the second clicking elements.

In this respect, an assembly will be two or more parts which may be combined. In the present case, a male and a female plug member are provided, wherein the female plug member has an elongate cavity extending along a longitudinal axis and having in the cavity one or more first signal conducting elements. These signal conducting elements may be fixed to an inner surface of the cavity or may be positioned thereat in any desired manner.

Naturally, the cavity may have only a single opening or be a channel or bore open at two ends. The cavity may, as will be elaborated on further below, be symmetric around the longitudinal axis, but this is not a requirement.

In this respect, the longitudinal axis will be the axis along which the male element may be introduced into the female element. This axis may also be a symmetry axis of the cavity of the female element and/or the male element.

Naturally, only part of the male plug member need be positioned within the cavity. This introducible part has the outer surface which again has thereon or thereat one or more second signal conducting elements. These elements may be fixed to the surface or be positioned thereat in any desired manner, such as glued thereto or molded therein.

Preferably, the positions of the first and second conducting elements are, when the male plug element is introduced into the cavity, such that a first conducting element contacts a second conducting element. In this respect, the signal conducting elements may be electrically conducting, whereby merely an abutting or biasing will suffice to transfer the signal. If sound or radiation conductors are used, also a more precise positioning, but not necessarily an abutment/biasing, is desired.

According to the an aspect of this disclosure, the male and female plug members each comprises clicking elements adapted to engage and provide a clicking action between the male and female plug members, when the male plug member is introduced into the female plug member.

In this manner, the fixing of the male plug member to the female plug member may be handled by the clicking elements and not the conductors which, especially if the assembly is very small, may be very small and thus not necessarily be able to provide a sufficiently large force.

Preferably, the clicking elements are adapted to obtain the clicking action when the male plug member is translated along the longitudinal axis into the cavity, such as if no rotation is provided between the male and female plug members.

The force required to engage the clicking elements and disengage these will depend on the situation. In the situation of miniature plugs, such as a plug having a cross section perpendicular to the longitudinal axis of 5 mm or less, such as 3 mm or less, for e.g. hearing aids or other miniature electronics, the engaging/separating force may be on the order of 10-20N.

According to an aspect of this disclosure, the second clicking element(s) is/are positioned, in a cross section in a plane perpendicular to the longitudinal axis, symmetrically in relation to a centre point, in the plane, between positions of the second clicking elements. In this situation, the force required to engage or disengage the clicking elements may be symmetrical in relation to the signal conducting elements, whereby the force exerted thereon may be smaller. Then, smaller or thinner signal conducting elements may be used.

In the present context, the symmetrical position may be one wherein one clicking element is positioned at the centre point, or multiple clicking elements are positioned symmetrically around the centre point, such as at the same distance and/or same angular directions, in the plane, from the centre point.

The centre point may be a centre point of a geometrical figure, in the plane, with the second conducting elements at its corners, and in another embodiment, the clicking elements are positioned at the edges of such a figure. Also, a centre of a circle having all second conducting elements on or at its periphery may be used. Alternatively, the centre point of any figure may be determined in the same manner as a centre of gravity of the figure.

Preferably, the clicking elements are provided with the same distances to the centre point and have at least substantially the same dimensions. Thus, if a number of engaging edges are provided, these preferably have the same dimensions (length and depth of engaging parts), and if clicking elements with a head and neck portion engaging a narrowing element are used, such portions preferably have the same dimension and engagement/disengagement forces.

In an embodiment, the first and/or the second conducting elements are elongate, electrically conducting members extending at least substantially along the longitudinal axis. In this manner, electrical connection between pairs of a first conductor and a second conductor may be ensured independently of the position of the male plug member along the longitudinal axis, at least within an interval of such positions. Alternatively, the first and second conductors may be surfaces engaging or touching only when the clicking elements engage.

In an embodiment, the elongate conducting members each have a surface positioned the farthest from a surface of the cavity or surface of the pertaining male or female member, i.e. directed away from that male/female member and toward the other, which surface extends at least substantially along the longitudinal axis. When these surfaces, which would be those engaged by the other of the first and second conductors, extend in the longitudinal direction, no locking or clicking action is seen while the male plug member is introduced into the female plug member. Thus, no such locking action is seen by the conductors in this situation. Again, this relaxes the strength requirements to the conductors.

In another embodiment, one of the first and the second clicking element, at least in a cross section including the longitudinal axis, has a neck portion, and wherein another of the first and second clicking elements has one or more elements engaging the neck portion. In this connection, a neck portion is a portion having a narrowing relative to at least a more outer part thereof, so that when the neck portion is engaged, a widening or deformation of the engaging elements is required to break the snap switching.

In an alternative embodiment, the clicking action is provided by one or more surfaces of the male plug member engaging surfaces of the female plug member to provide the snap switch action.

In an embodiment, the assembly has three or more first and second conducting elements, wherein the first and second clicking elements are positioned, in a cross section perpendicular to the longitudinal axis, within a geometrical figure having the conducting elements at its periphery. Especially if the clicking elements are positioned at a centre of the male/female plug members in a plane perpendicular to the longitudinal axis, the force required for engaging and disengaging the snap switch may be provided along the longitudinal axis without excessive force exertion on the conductors. The conductors thus may be provided rather thin and fragile while allowing the snap switch action.

In an embodiment, the first and/or second clicking elements is/are rotationally symmetric around the longitudinal axis, but this is not required.

In another embodiment, the cavity and the outer surface, in a cross section perpendicular to the longitudinal axis, are non-circular, such as triangular, quadrangular, pentagonal or so on, so that the rotational position(s) at which the male plug member may enter the female plug member is/are limited. Then, it may be assured that the pairs of engaging or contacting conductors are those desired.

Preferably, the cross sections have a shape with only one possible angular rotational position. This may be provided by not providing a geometric shape with any symmetry. Thus the shape of a drop or any other shape with this characteristic may be used.

Another aspect of this disclosure relates to a male element for use in the assembly according to the first aspect. Naturally, all the above characteristics and preferences are equally valid for this aspect.

Yet another aspect of the disclosure relates to a female element for use in the assembly according to the first aspect. Naturally, all the above characteristics and preferences are equally valid for this aspect.

BRIEF DESCRIPTION OF THE DRAWINGS

In the following, an embodiment of this disclosure will be described with reference to the drawing, wherein.

Figure 1:
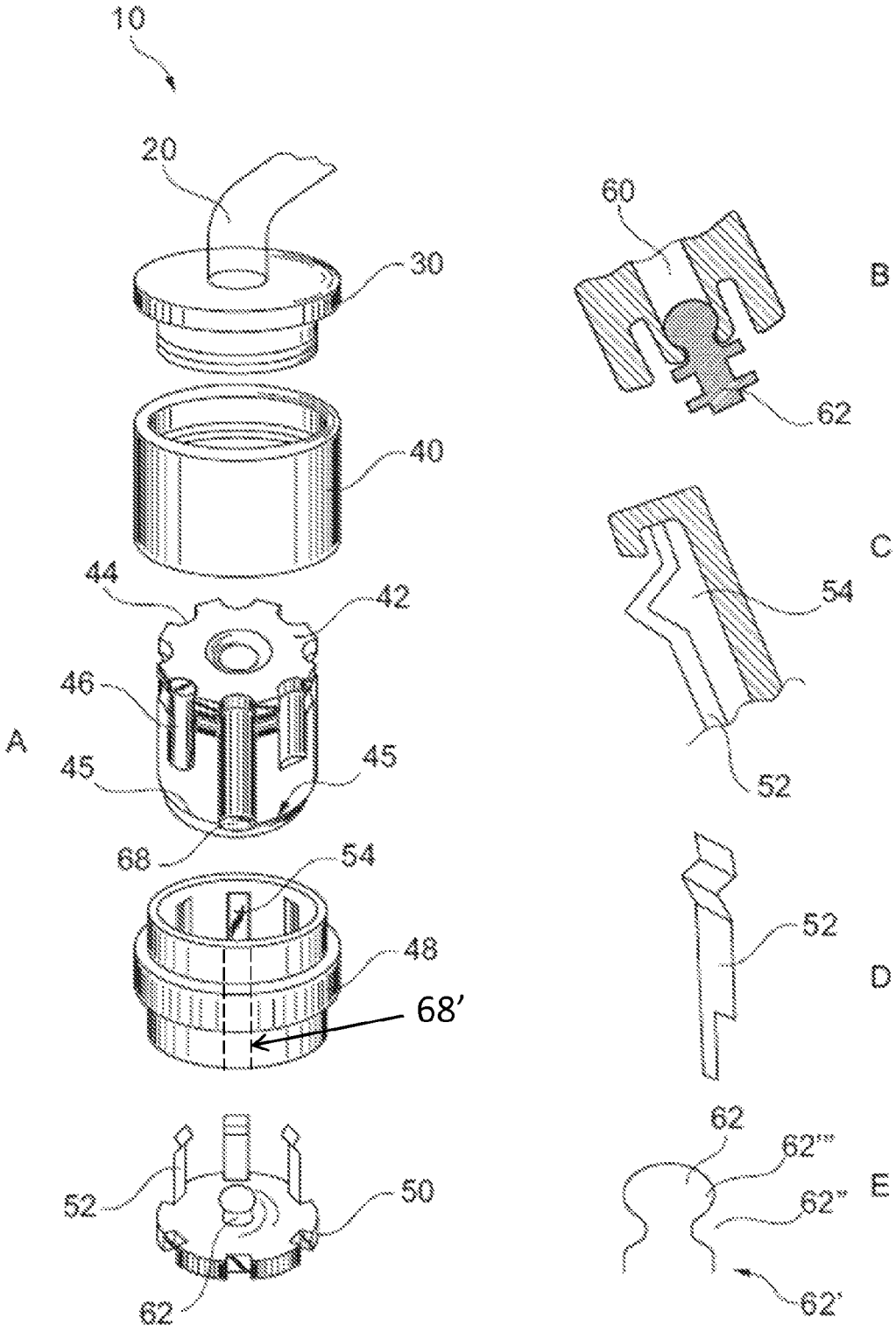
FIG. 1 illustrates a preferred assembly according to an aspect of this disclosure.

While the aspects in this disclosure are susceptible to various modifications and alternative forms, specific embodiments thereof have been shown by way of example in the drawings and will herein be described in detail. It should be understood, however, that it is not intended to limit the disclosed aspects to the particular forms disclosed but, on the contrary, the intention is to cover all modifications, equivalents, and alternatives falling within the spirit and scope of the invention as defined by the appended claims.

DETAILED DESCRIPTION OF THE DRAWINGS

FIG. 1 illustrates a preferred embodiment of an assembly 10 comprising a male plug member for positioning within a female plug member.

Figure 3:
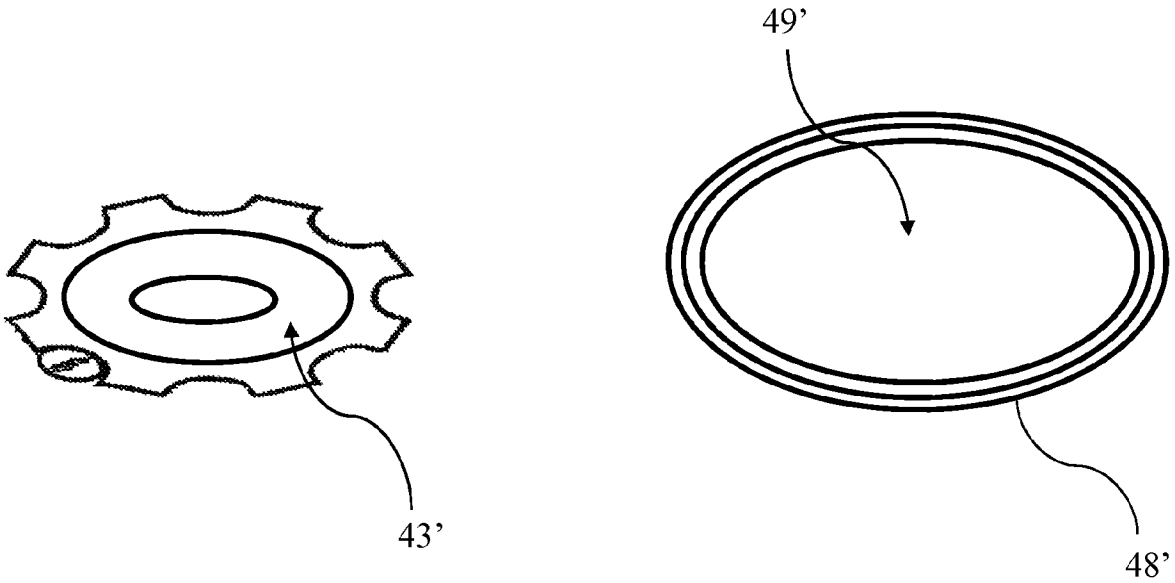
FIG. 3 illustrates top views of the outer surface of the male plug member and the cavity of the outer element.

More particularly, the male plug member comprises a cable 20 having therein conductors for connection to first, elongate conducting elements 46 positioned in grooves 44 of an outer surface, such as an outer surface 43' shown in FIG. 3, of an element 42, part of which is to be introduced into a female plug member. The male plug member also has an outer shielding portion 40 for fixing to a top portion 30 to which the cable 20 is fixed.

The elongate rod-like elements 46 may be fixed in any desired manner.

The female plug member comprises an outer element 48 or 48' having therein a cavity, such as the cavity 49' shown in FIG. 3, having a number of grooves 54 each being adapted to receive and hold a second conducting element 52. It is seen that a top of the groove 54 has a cavity into which the top of the second conducting element 52 extends so as to be fixed or at least guided inside the groove 54.

The second conducting elements 52 are shaped from flat, bent metal so as to be able to bias against the elements 46 and are fixed to a base element 50, such as inside cut-out portions corresponding in position with the grooves 54. Thus, the elements 52 may be guided into the grooves 54 by introducing the base element 50 into the lower portion of the outer element 48.

Thus, when introducing the male plug member inside the female plug member, each first element 46 will contact a second element 52, which will be translated along the first element 46 during insertion. The shape of the element 52 will ensure electrical contact by biasing.

When the male plug element is positioned fully inside the female plug element, a snap switching element 62 having a shoulder portion 62', a neck portion 62" and a head portion 62'" will be introduced into a central bore 60 of the male plug element and be snap fitted therein by one or more elements of the male plug element engaging the neck portion 62" of the snap switching element 62.

Preferably, the outer surface of the elements 46, i.e. the surface contacting the second elements 52, extends at least substantially along the longitudinal axis along which the male plug element is introduced into the female plug element, so that the engagement between the elements 46 and 52 is at least substantially the same at any position along the longitudinal axis during introduction. With other words, preferably no snap switching or particular locking is provided by the elements 46 and 52 apart from the biasing ensuring electrical connection there between. The snap switching is provided solely, preferably, by the interaction of the element 62 and the engaging parts of the male plug element. The engaging parts of the male plug element may be individual arms or elongated elements or may be a narrowing of the channel 60 into which the head part 62''' of the element 62 only fits if forced there through with at least a predetermined force.

Preferably, the force required to obtain the snap switching is 10-15N or more. In this respect, the element 62 may be made of any suitable material, such as steel, titanium, brass, silver or the like.

Any number of first and second conductors 46/52 may be provided, and preferably, the element 62 is provided between these conductors, in a plane perpendicular to the longitudinal axis, such as within a geometrical figure having the conductors at its periphery. This figure may be a circle, a triangle, a square/tetragon, a pentangle, hexagon, or the like. In this manner, the forces of engaging the snap switching may be substantially symmetrical to the individual first and second elements 46/52. Then, attachment/detachment may take place without requiring or exerting excessive forces to the conductors 46/52 which may by made very thin, as is desired especially in very small plugs for e.g. hearing aids.

An alternative to the single element 62, multiple such snap latching or switching elements may be provided in the base element 50. Some of these may be provided in the element 42 and extend into grooves in the base element 50.

A further alternative may be the providing of snap latching or switching edges provided on the outer periphery of the element 42, such as where indicated by the reference numerals 45, for engagement with edges (not illustrated) directed inwardly into the cavity from the cavity walls of the outer element 48. Naturally, a combination of edges and elements 62 may be used.

In order to ensure that the correct conductors 46 are connected to the correct conductors 52, the outer surface of the male plug member, on which the elements 46 are positioned, as well as the inner surface of the element 48, where the conductors 52 are positioned, are, in a plane perpendicular to the longitudinal axis, non-circular. Alternatively, the positions of the conductors 46/52 may be on a non-circular geometrical figure in the cross section. In this manner, it may be ensured that only one or a number of predetermined rotational positions of the male plug member in relation to the female plug member, are possible, all of which provides the desired interconnection between pairs of conductors 46/52.

Alternatively, a guiding element 68' may be provided in the female plug element, extending from the inner surface thereof, which extends into an outer groove 68 of the male plug element, which guiding element 68' again defines a desired rotational position of the male and female plug members in which the male plug member is able to be introduced into the female plug member.

It is noted that the action of the elongate conductors 46 may be transferred to the female plug member, as may the position of the element 62. In addition, the snap switching element may be replaced by a plurality of snap switching elements, such as a number of edge portions adapted to interlock with edge portions of the other of the male and female plug elements.

Figure 2:
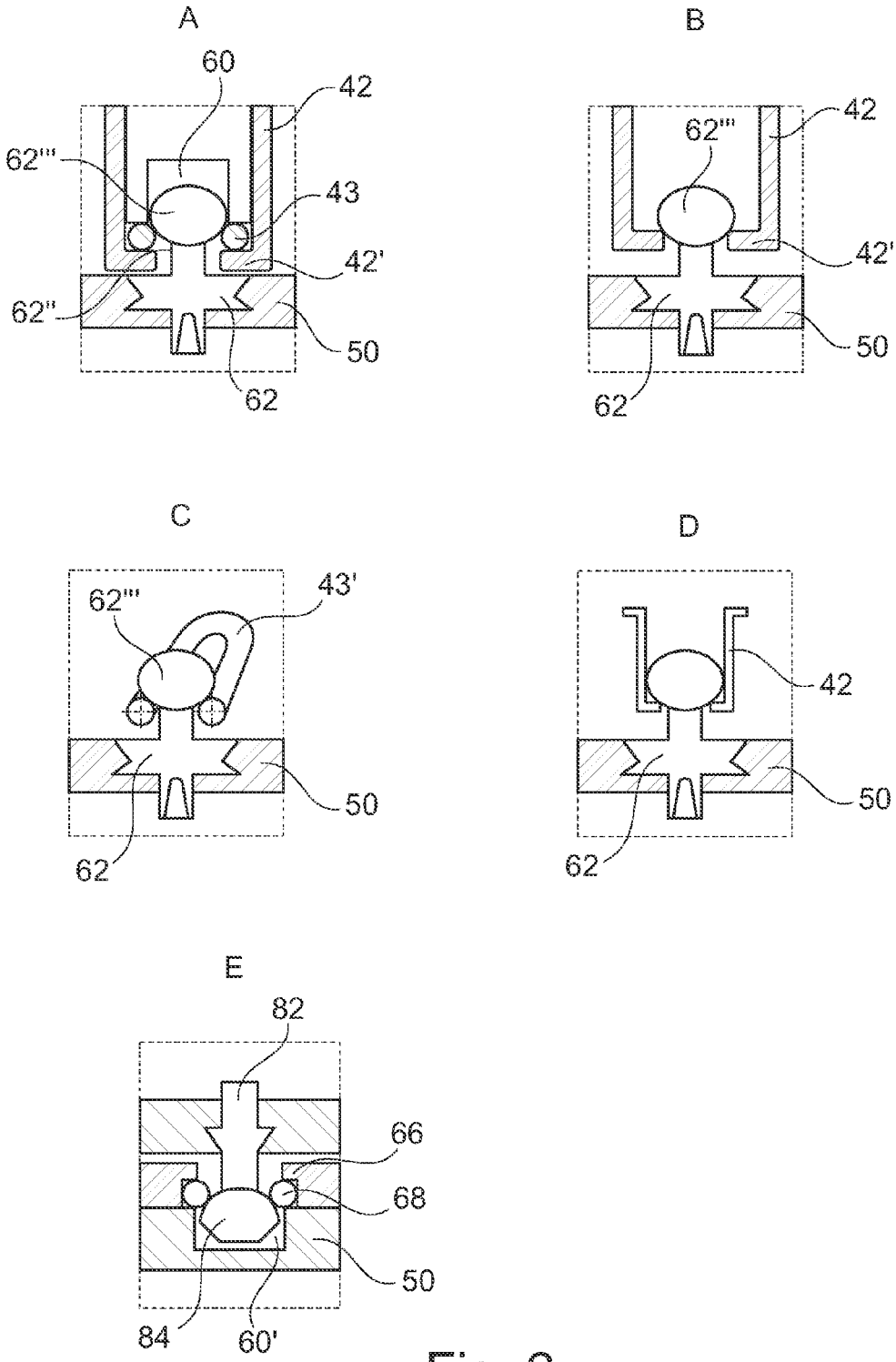
FIG. 2 illustrates different manners of providing a clicking action between a plug and a socket.

In FIG. 2, different manners of providing a clicking action between a male plug and a female plug in order to ensure sufficient engagement there between during operation.

In FIG. 2A, the base element 60 of the female plug which the insert 62 is provided having an upwardly extending part with a head portion 62'''. The male plug is provided at the top with a base part 42 extending into the cavity (not illustrated) of the female plug. The base part has inwardly extending parts 42' through which the head portion 62''' extends and which support a narrowing part 43 which locks around the neck portion 62'' of the insert 62 and makes removal or retraction of the head portion 62''' possible only with a force exceeding a predetermined force. The narrowing part 43 may be a rubber O-ring or the like.

In FIG. 2B, the locking action is provided by the inwardly extending parts 42'.

In FIG. 2C, the locking is provided by a U-shaped element 43', which may be attached to the base part 42, which is not illustrated in this figure. This U-shaped element 43' may be a metal element, a plastic element or another element which by proper selection of material and dimensions gives the desired fixing force.

In FIG. 2D, the base part 42 may be made of a stronger material, compared to FIG. 4B, and may thus be made thinner. Again, selection of the material properties and the dimensions will define the fixing force and the force required for detachment.

FIG. 2E is of an inverted structure in which a cavity 60' is provided in the base element 50 of the female part. The male part has an extending element 82 fastened to the base part 42 and which is provided having a head portion 84 extending into the cavity 60' and being locked therein by a narrowing element 68, such as an O-ring, which is kept in place by narrowing parts 66. Again, the material properties and dimensions of the narrowing element 68 will define the fixing and detachment forces.

Naturally, the above electrical conductors may be fully or partly replaced by sound or light guides, depending on the situation, such as the amount of information transported etc.

Also, the element 62 and one or more of the parts engaging the neck portion 62' may be electrically conducting, or sound/light conductors may be provided so that also this part may be used for transporting information in the form of electric signals, sound or radiation.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. An assembly comprising a male plug member, a female plug member, and a base element, wherein:

the female plug member has an elongate cavity with an opening, the cavity extending along a longitudinal axis and having in the cavity one or more first signal conducting elements, each one of the one or more first signal conducting elements having a first end and a second end, the male plug member having an outer surface being adapted to be positioned at least partly within the cavity, one or more second signal conducting elements being provided at or on the outer surface, each one of the one or more second signal conducting elements having a first end and a second end, the male plug member having one or more first clicking elements, the female plug member having one or more second clicking elements being adapted to interact with and click together with the one or more first clicking elements when the male plug member is introduced into the female plug member along the longitudinal axis, the one or more first and second signal conducting elements being positioned so as to engage or abut when the one or more first and second clicking elements are clicked together, wherein the engagement of the one or more first and second signal conducting elements occurs simultaneously with the clicking of the one or more first and second clicking elements, wherein the second clicking element(s) is/are positioned, in a cross section in a plane perpendicular to the longitudinal axis, symmetrically in relation to a centre point, in the plane, between positions of the first signal conducting elements, and wherein the outer surface of the male plug member has a number of first grooves, each one of the first grooves including a first groove cavity in a top thereof and holding a corresponding second signal conducting element of the one or more second signal conducting elements, the first end of the corresponding second signal conducting element being fixed in the base element and the second end of the corresponding second signal conducting element extending into the first groove cavity of a corresponding one of the first grooves, the one or more first signal conducting elements being elongate, electrically conducting members extending at least substantially along the longitudinal axis, or wherein the female plug member has an outer element, the outer element including a number of second grooves, each one of the second grooves including a second groove cavity in a top thereof and holding a corresponding first signal conducting element of the one or more first signal conducting elements, the first end of the corresponding first signal conducting element being fixed in the base element and the second end of the corresponding first signal conducting element extending into the second groove cavity of a corresponding one of the second grooves, the one or more second signal conducting elements being elongate, electrically conducting members extending at least substantially along the longitudinal axis.

2. An assembly according to claim 1, wherein the one or more first and/or the one or more second signal conducting elements provided in the number of grooves are shaped from flat and bent metal and wherein the one or more first and the one or more second signal conducting elements extend along the longitudinal axis.

3. An assembly according to claim 1, comprising three or more first and second conducting elements, and wherein the first and second clicking elements are each positioned, in a cross section perpendicular to the longitudinal axis, within a geometrical figure having the conducting elements at its periphery.

4. An assembly according to claim 3, wherein the second clicking elements are positioned within the geometrical figure, in the cross section.

5. An assembly according to claim 1, wherein the cavity and the outer surface, in a cross section perpendicular to the longitudinal axis, are non-circular.

6. An assembly according to claim 1, wherein each one of the second grooves of the outer element of the female plug member holds the corresponding first signal conducting element of the one or more first signal conducting elements, and wherein the elongate electrically conducting members are positioned in the male member.

7. A male element comprising:

a base element, an outer surface at or on which one or more second signal conducting elements are provided, each one of the one or more second signal conducting elements having a first end and a second end, the one or more second signal conducting elements being configured to engage with one or more first signal conducting elements, the one or more first signal conducting elements being elongate, electrically conducting members extending at least substantially along a longitudinal axis, and one or more first clicking elements, positioned, in a cross section in a plane perpendicular to the longitudinal axis, symmetrically in relation to a centre point, in the plane, between positions of the second signal conducting elements, wherein the outer surface has a number of grooves, each one of the grooves including a groove cavity in a top thereof and holding a corresponding second signal conducting element of the one or more second signal conducting elements, the first end of the corresponding signal conducting element being fixed in the base element and the second end of the corresponding second signal conducting element extending into the groove cavity of a corresponding one of the grooves.

8. A female element comprising:

a base element, an outer element, one or more second clicking elements being adapted to interact with and click together with one or more first clicking elements, and an elongate cavity with an opening, the cavity extending along a longitudinal axis and having in the cavity one or more first signal conducting elements, each one of the one or more first signal conducting elements being elongate and having a first end and a second end, the one or more first signal conducting elements being configured to engage with one or more second signal conducting elements, wherein the outer element has a number of grooves, each one of the grooves including a groove cavity in a top thereof and holding a corresponding first signal conducting element of the one or more first signal conducting elements, the first end of the corresponding first signal conducting element being fixed in the base element and the second end of the corresponding first signal conducting element extending into the groove cavity of a corresponding one of the grooves.

9. An assembly according to claim 1, wherein no rotation is required to click together the male plug member and the female plug member and to engage the first and second signal conducting elements.

10. An assembly according to claim 1, wherein no rotation is required between the male plug member and the female plug member to disengage the first and second clicking elements and the first and second signal conducting elements.

11. An assembly comprising a male plug member, a female plug member and a base element, wherein:

the female plug member has an elongate cavity with an opening, the cavity extending along a longitudinal axis and having in the cavity one or more first signal conducting elements, each one of the one or more first signal conducting elements having a first end and a second end, the male plug member having an outer surface being adapted to be positioned at least partly within the cavity, one or more second signal conducting elements being provided at or on the outer surface, each one of the one or more second signal conducting elements having a first end and a second end, the male plug member having one or more first clicking elements, the female plug member having one or more second clicking elements being adapted to interact with and click together with the one or more first clicking elements when the male plug member is introduced into the female plug member along the longitudinal axis, the one or more first and second signal conducting elements being positioned so as to engage or abut when the one or more first and second clicking elements are clicked together, wherein the one or more second clicking element(s) is/are positioned, in a cross section in a plane perpendicular to the longitudinal axis, symmetrically in relation to a centre point, in the plane, between positions of the one or more first signal conducting elements, and wherein no rotation is required to click together the male plug member and the female plug member and to engage the one or more first and second signal conducting elements, and wherein the outer surface of the male plug member has a number of first grooves, each one of the first grooves including a first groove cavity in a top thereof and holding a corresponding second signal conducting element of the one or more second signal conducting elements, the first end of the corresponding second signal conducting element being fixed in the base element and the second end of the corresponding second signal conducting element extending into the first groove cavity of a corresponding one of the first grooves, the one or more first signal conducting elements being elongate, electrically conducting members extending at least substantially along the longitudinal axis, or wherein the female plug member has an outer element, the outer element including a number of second grooves, each one of the second grooves including a second groove cavity in a top thereof and holding a corresponding first signal conducting element of the one or more first signal conducting elements, the first end of the corresponding first signal conducting element being fixed in the base element and the second end of the corresponding first signal conducting element extending into the second groove cavity of a corresponding one of the second grooves, the one or more second signal conducting elements being elongate, electrically conducting members extending at least substantially along the longitudinal axis.

12. An assembly according to claim 11, further comprising a guiding element extending from an inner surface of the female plug element, the guiding element extending into an outer groove of the male plug element, which guiding element defines a desired rotational position of the male and female plug members in which the male plug member is able to be introduced into the female plug member.

13. An assembly comprising a male plug member, a female plug member and a base element, wherein:

the female plug member has an elongate cavity with an opening, the cavity extending along a longitudinal axis and having in the cavity one or more first signal conducting elements each one of the one or more first signal conducting elements having a first end and a second end, the male plug member having an outer surface being adapted to be positioned at least partly within the cavity, one or more second signal conducting elements being provided at or on the outer surface each one of the one or more second signal conducting elements having a first end and a second end, the male plug member having one or more first clicking elements, the female plug member having one or more second clicking elements being adapted to interact with and click together with the one or more first clicking elements when the male plug member is introduced into the female plug member along the longitudinal axis, the one or more first and second signal conducting elements being positioned so as to engage or abut simultaneously with the one or more first and second clicking elements being clicked together, such that the clicking together of the one or more first and second clicking elements causes the engagement of the one or more first and second signal conducting elements, wherein the one or more second clicking element(s) is/are positioned, in a cross section in a plane perpendicular to the longitudinal axis, wherein the outer surface of the male plug member has a number of first grooves, each one of the first grooves including a first groove cavity in a top thereof and holding a corresponding second signal conducting element of the one or more second signal conducting elements, the first end of the corresponding second signal conducting element being fixed in the base element and the second end of the corresponding second signal conducting element extending into the first groove cavity of a corresponding one of the first grooves, the one or more first signal conducting elements being elongate, electrically conducting members extending at least substantially along the longitudinal axis, or wherein the female plug member has an outer element, the outer element including a number of second grooves, each one of the second grooves including a second groove cavity in a top thereof and holding a corresponding first signal conducting element of the one or more first signal conducting elements, the first end of the corresponding first signal conducting element being fixed in the base element and the second end of the corresponding first signal conducting element extending into the second groove cavity of a corresponding one of the second grooves, the one or more second signal conducting elements being elongate, electrically conducting members extending at least substantially along the longitudinal axis.

14. An assembly according to claim 13, wherein the second clicking elements are positioned symmetrically in relation to a centre point, in the plane, between positions of the first signal conducting elements.

15. An assembly according to claim 13, wherein the first and/or the second conducting elements are elongate, electrically conducting members extending at least substantially along the longitudinal axis.

16. An assembly according to claim 13, comprising three or more first and second conducting elements, and wherein the first and second clicking elements are each positioned, in a cross section perpendicular to the longitudinal axis, within a geometrical figure having the conducting elements at its periphery.

17. An assembly according to claim 13, wherein the male plug member and the female plug member click together and the first and second signal conducting elements engage by introducing the male plug member into the female plug member and pushing them together until a clicking noise is produced, such that no rotation is required between the male plug member and the female plug member.

18. An assembly according to claim 13, wherein disengaging the male plug member from the female plug member requires no rotation and is achieved by pulling the male plug member from the female plug member.

19. An assembly according to claim 1, wherein each one groove of the first grooves of the outer surface of the male plug member holds the corresponding second signal conducting element of the one or more second signal conducting elements and wherein the elongate electrically conducting members are positioned within the female member.

20. An assembly according to claim 1, wherein the first grooves are located on an inner surface of the outer surface of the male plug member or wherein the second grooves are located on an inner surface of the outer element of the female plug member.

21. An assembly according to claim 7, wherein the one or more second conducting elements extend along the longitudinal axis and are shaped from flat and bent metal.

22. An assembly according to claim 11, wherein the one or more first and/or the one or more second conducting elements provided in the number of grooves are shaped from flat and bent metal.

23. An assembly according to claim 13, wherein the one or more first and/or the one or more second conducting elements provided in the number of grooves are shaped from flat and bent metal.

* * * * *